United States Patent [19]

Amwake

[11] 4,332,202

[45] Jun. 1, 1982

[54] SIDE BEARING CAGE ASSEMBLY

[75] Inventor: Harvey E. Amwake, West Falls, N.Y.

[73] Assignee: Dresser Industries, Inc., Dallas, Tex.

[21] Appl. No.: 162,474

[22] Filed: Jun. 24, 1980

Related U.S. Application Data

[63] Continuation-in-part of Ser. No. 853,652, Nov. 21, 1977, abandoned.

[51] Int. Cl.[3] ..... B61F 5/14; B61F 5/24; F16C 17/04

[52] U.S. Cl. ..... 105/199 CB; 248/544; 308/138

[58] Field of Search ..... 105/199 CB, 226, 230; 267/166, 170, 178, 179; 308/138; 248/544, 500; 403/11, 12, 13, 14

[56] References Cited

U.S. PATENT DOCUMENTS

| | | | |
|---|---|---|---|
| 1,717,045 | 6/1929 | Larsen | 105/199 CB X |
| 1,728,336 | 9/1929 | Downey | 308/138 |
| 1,897,836 | 2/1933 | Bristol | 267/178 |
| 1,923,435 | 8/1933 | Gilpin | 267/179 X |
| 3,329,098 | 7/1967 | Williams | 105/199 CB X |
| 3,388,885 | 6/1968 | Holmes | 248/500 X |
| 3,845,725 | 11/1974 | Gierlach | 105/199 CB X |
| 4,000,931 | 1/1977 | Geyer | 105/199 CB X |
| 4,130,066 | 12/1978 | Mulcahy | 308/138 X |

*Primary Examiner*—Joseph F. Peters, Jr.
*Assistant Examiner*—Howard Beltran
*Attorney, Agent, or Firm*—Raymond T. Majesko

[57] ABSTRACT

Raised pads of minimum area are provided on the top surface of a railroad truck bolster to cooperate with and present maximum support to the side bearings with only minor grinding operations needed to the as-cast surface to assure full bearing.

6 Claims, 3 Drawing Figures

SIDE BEARING CAGE ASSEMBLY

RELATED APPLICATION

This is a continuation-in-part of application Ser. No. 853,652 filed Nov. 21, 1977, now abandoned.

Railroad truck bolsters cooperate with the car body in providing the interface between the body and the truck comprising principally the center plate which takes the vertical load and the side bearings which come into play to limit the car body lateral roll about the center plate.

The side bearings are usually separate units mounted upon the top surface of the truck bolster and secured by bolts, rivets or special fasteners, and they cooperate with the body side bearings which are tapered section plates attached to the underside of the body bolster.

There have been many instances of the side bearings becoming loose in service due to a severe rolling condition, referred to in the industry as rock-and-roll brought about by synchronous matching of car body natural roll frequency with the disturbing frequency of low rail joints, and the fact that the bearings were not properly seated initially.

It is essential therefore that considerable attention is required in the application of side bearings to assure that they are properly seated so that they will not become loose under the repeated loadings they must sustain.

This invention addresses the particular problem of providing a seat design and gaging system that will assure the necessary accuracy of the bearing surface and thereby the correct mounting condition for the side bearings to remain tight in service.

The current method of producing the mounting surface for the side bearings involves casting an area of approximately 11×14 level and with a depressed section in the center. Since the economics of bolster production prohibits machining of this surface, a grinder is faced with the task of grinding the areas of contact with the side bearing to within 1/32 of flatness and in the correct plane.

This often involves the removal of a considerable amount of metal and is very difficult to gage.

The object of the invention then is the provision of raised pads and bosses on the bolster surface to match only the specific bearing locations required by the side bearing in transferring the car body loads to the bolster. Also, a gaging procedure to indicate to the grinder how to remove the minimum amount of metal to provide an in-tolerance bearing seat is available.

Other objects will become apparent to those skilled in the art from the following description taken in connection with the accompanying drawings wherein.

Figure 1:
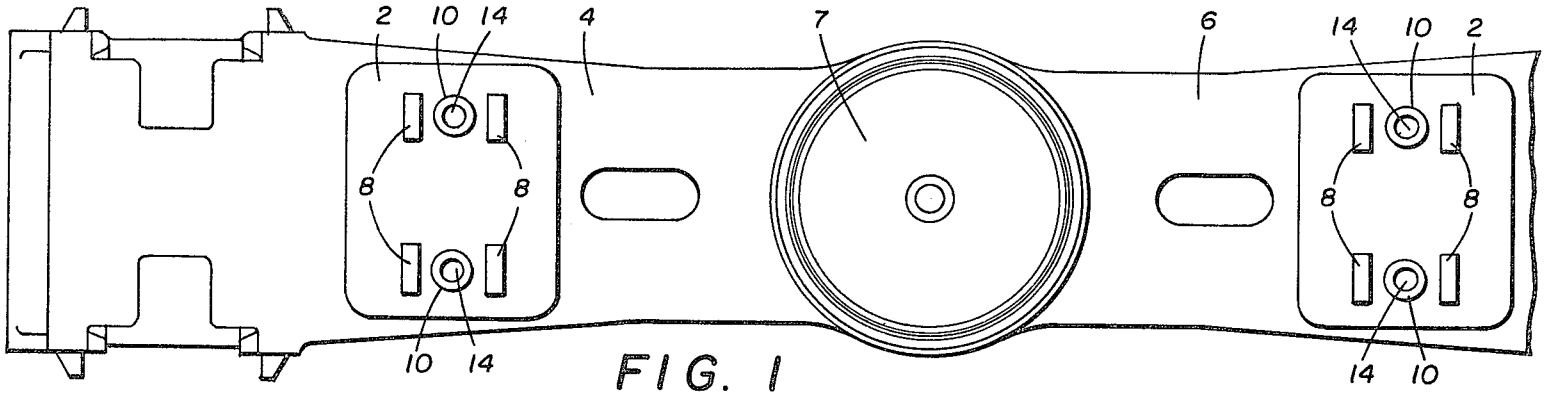
FIG. 1 is a plan view of the side bearing seat construction of the invention on the truck bolster top surface.
Figure 2:
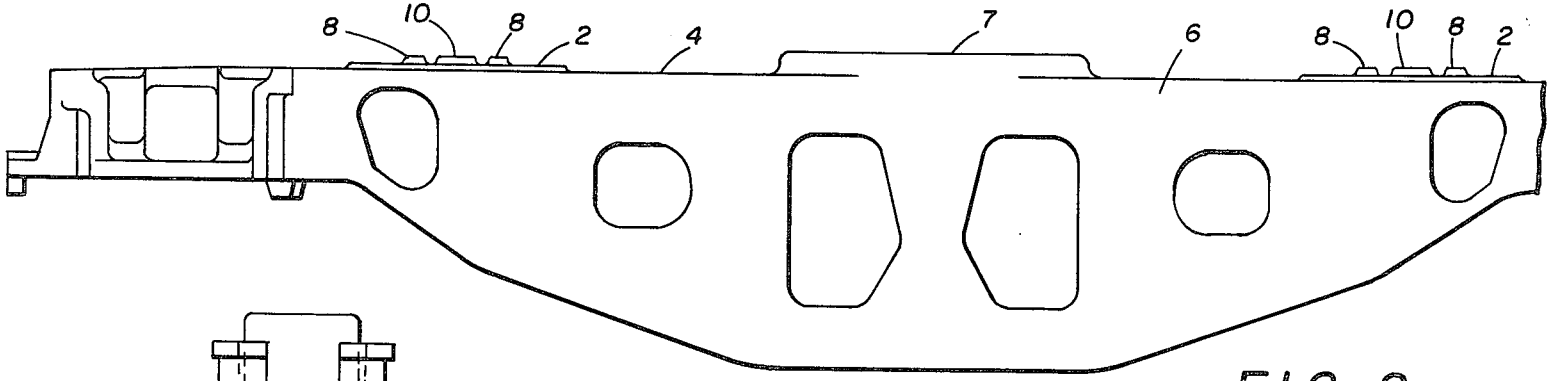
FIG. 2 is an elevation view partly in cross section of the construction of FIG. 1.
Figure 3:
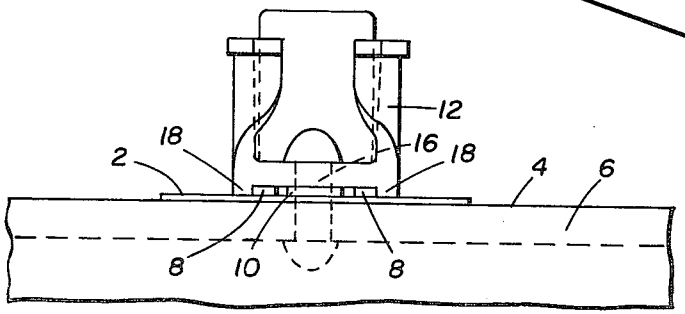
FIG. 3 is an elevation view showing a side bearing mounted on the raised portion of the truck bolster.

Referring now in detail to the accompanying drawings in which like reference characters designate like parts, the improved side bearing seat 2 of the present invention is formed on the upper surface 4 of the truck bolster 6 (shown in part), having a centrally located bearing means 7 and comprises four raised rectangular pads 8 and two circular bosses or pads 10 for seating of a side bearing cage 12. The bosses 10 contain an aperture 14 for receiving a bolt or rivet 16.

The side bearing cage 12 contains lower end flanges 18 for seating in abutment with the pads 8. This enables the side bearing to transfer car body loads to the truck bolster.

The seating area for grinding to gage is considerably reduced by the instant invention by comparison with the area which must normally be ground to comply with the proper gage using the existing or previous methods.

Both the level of the side bearing seat 2 and the fit-up with the side bearing cage are thus much simpler to achieve and results in a properly secured side bearing which will not loosen in service.

The pads 8 and 10 are only 1/64" to 1/32" higher than the typical ⅛" raised truck bolster bearing surface.

The foregoing should be construed as illustrative and not in limitation of the invention.

The embodiments of the invention in which an exclusive property or privilege is claimed are defined as follows:

1. In a railway car truck bolster having an upper surface with a substantially centrally located side bearing means near ends of the bolster, the improvement comprising a plurality of vertically extending pads disposed on the upper surface of the bolster near the ends for cooperation with a side bearing cage to match only specific cage bearing portions as required by the pads to locate the side bearing cage to effect transfer of the lateral and longitudinal car body loads to the bolster.

2. Bolster according to claim 1, in which there are opposed pairs of parallel pairs of pads on the upper surface of the bolster near each end thereof.

3. Bolster according to claim 2, in which the pairs of pads are rectangular in configuration.

4. Bolster according to claim 1, in which there is a bolt receiving aperture in the upper surface of the bolster between each pair of parallel pads.

5. Bolster according to claim 4, in which there is a vertically extending pad surrounding each aperture.

6. Bolster according to claim 5, in which said pad is circular in configuration.

* * * * *